US009761391B2

(12) United States Patent
Izumi

(10) Patent No.: US 9,761,391 B2
(45) Date of Patent: Sep. 12, 2017

(54) ROTARY KNOB

(71) Applicant: Yamaha Corporation, Hamamatsu-shi, Shizuoka-ken (JP)

(72) Inventor: Ryuichi Izumi, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 330 days.

(21) Appl. No.: 14/541,218

(22) Filed: Nov. 14, 2014

(65) Prior Publication Data

US 2015/0136575 A1 May 21, 2015

(30) Foreign Application Priority Data

Nov. 18, 2013 (JP) ..... 2013-238161

(51) Int. Cl.
*G05G 1/12* (2006.01)
*H01H 19/14* (2006.01)

(52) U.S. Cl.
CPC ..... *H01H 19/14* (2013.01); *G05G 1/12* (2013.01)

(58) Field of Classification Search
CPC ..... H01H 19/14; G05G 1/12
See application file for complete search history.

(56) References Cited

U.S. PATENT DOCUMENTS 2,149,746 A 3/1939 Pfeiffer
2,256,419 A * 9/1941 Tinnerman ..... G05G 1/12 16/DIG. 24
2,697,143 A * 12/1954 Despard ..... H01H 21/02 200/438
3,193,312 A * 7/1965 Ehner ..... G05G 1/12 292/349
4,067,658 A 1/1978 Ueno et al.
(Continued)

FOREIGN PATENT DOCUMENTS

CN 201066644 Y 5/2008
CN 202384235 U 8/2012
(Continued)

OTHER PUBLICATIONS

Chinese Office Action issued in counterpart Chinese Application No. 201410659816.5 dated Apr. 21, 2016 with English translation (11 pages).

(Continued)

*Primary Examiner* — David M Fenstermacher
(74) *Attorney, Agent, or Firm* — Crowell & Moring LLP

(57) ABSTRACT

A rotary knob includes: a wall member defining a mating hole in which a rotation shaft including a shaft portion whose outer circumferential surface has a flat surface extending parallel with an axis of the rotation shaft can be fitted; and an elastic piece formed in a strip shape and formed on an inner surface of the wall member so as to extend along an axis of the wall member. The elastic piece is in contact with the flat surface and elastically deformed when the rotation shaft is fitted in the mating hole. The elastic piece includes: opposite side portions fixed to the inner surface of the wall member; and a central portion in a widthwise direction perpendicular to the axis of the wall member. The elastic piece includes a convex surface constituted by the central portion which curves inward in a radial direction of the mating hole.

8 Claims, 6 Drawing Sheets

(56) References Cited

U.S. PATENT DOCUMENTS

| | | | | |
|---|---|---|---|---|
| 4,295,246 | A * | 10/1981 | Howie, Jr. | F16D 1/0858 16/441 |
| 5,845,365 | A * | 12/1998 | Howie, Jr. | B29C 45/16 116/309 |
| 6,073,312 | A * | 6/2000 | Dao | B60R 21/09 16/441 |
| 6,896,442 | B1 * | 5/2005 | Howie, Jr. | F16D 1/0858 403/282 |
| 2003/0163903 | A1 * | 9/2003 | Rodawold, Jr. | B60K 37/06 16/441 |
| 2003/0221498 | A1 | 12/2003 | Mere et al. | |
| 2005/0173232 | A1 * | 8/2005 | Horton | H01H 19/11 200/11 R |
| 2009/0151505 | A1 * | 6/2009 | Castillo | G05G 1/12 74/553 |
| 2011/0072932 | A1 * | 3/2011 | O'Keefe | B60K 37/06 74/504 |

FOREIGN PATENT DOCUMENTS

| | | | |
|---|---|---|---|
| FR | 2 533 334 | A1 | 3/1984 |
| JP | 50-83537 | U | 12/1973 |
| JP | 58-132225 | U | 9/1983 |
| JP | 6-79039 | U | 11/1994 |
| JP | 8-161973 | A | 6/1996 |
| JP | 10-111373 | A | 4/1998 |

OTHER PUBLICATIONS

European Search Report dated Jan. 15, 2015 (Four (4) pages).

Chinese-language Office Action issued in counterpart Chinese Application No. 201410659816.5 dated Dec. 16, 2017 with English translation (11 pages).

Japanese-language Office Action issued in counterpart Japanese Application No. 2013-238161 dated May 23, 2017 with English translation (five (5) pages).

* cited by examiner

ROTARY KNOB

CROSS REFERENCE TO RELATED APPLICATION

The present application claims priority from Japanese Patent Application No. 2013-238161, which was filed on Nov. 18, 2013, the disclosure of which is herein incorporated by reference in its entirety.

BACKGROUND

Field of the Invention

The present invention relates to a rotary knob which is provided on an operation portion of an electronic device or the like and which is to be turned in a state in which the rotary knob is fitted on a rotation shaft.

Description of the Related Art

Rotary knobs are used for electronic devices such as mixing consoles to adjust volumes, for example. Such a rotary knob is constructed to be turnable in a state in which a rotation shaft is fitted in a mating hole, and is constructed to be removable from and mountable on the rotation shaft for repair, for example. Thus, the rotary knob needs an appropriate removal force which is required for the rotary knob to be removed from the rotation shaft. Accordingly, the rotary knob is preferably constructed such that a surface defining the mating hole into which the rotation shaft is to be inserted is in contact with the rotation shaft and such that the mating hole can absorb an error in the diameter of the rotation shaft.

For example, Patent Document 1 (Japanese Patent Application Publication No. 10-111373) discloses a rotary knob in which a mating portion to be fitted on a rotation shaft is constituted by a plurality of mating pieces defining a plurality of slits, and each of the mating pieces is connected to an outer wall member (outer circumferential member) of the rotary knob by an elastically deformable rib. This construction can provide an appropriate removal force and absorb an error in the diameter of the rotation shaft when the rotary knob is fitted on the rotation shaft. However, the mating portion and the outer wall member are shaped like a double-ply tube, resulting in increase in diameter of the rotary knob.

In small rotary knobs, in general, an outer wall member in most cases also serves as a mating portion due to physical limitation of size, making it difficult for the rotary knob to have the above-described construction.

As the rotary knob in which the mating portion is constituted by the outer wall member, Patent Document 2 (Japanese Unexamined Utility Model Application Publication No. 6-079039) discloses a rotary knob, for example. This rotary knob has a mating hole in which a rotation shaft including a cutout portion having a D-shape in cross section is to be fitted. Provided on an inner circumferential surface of the mating hole are a plurality of projections and an elastic portion to be engaged with a portion of the rotation shaft which is formed by the cutout portion. The projections and the elastic portion of the mating hole support the portion of the rotation shaft which is formed by the cutout portion, to stabilize a removal force.

SUMMARY

In the rotary knob disclosed in Patent Document 2, however, the projections come in point contact with the portion of the rotation shaft which is formed by the cutout portion. Thus, in a case where the rotation shaft is formed of metal, and the rotary knob is formed of resin, repetitive insertions and removals of the rotary knob may scrape the projections, leading to great deterioration of the removal force.

In a case where an angle of the mating hole with respect to the rotation shaft is misaligned even slightly in the rotational direction of the rotation shaft in assembling of the rotary knob on the rotation shaft, the assembling is difficult, and furthermore the rotary knob needs to be assembled to an accurate position in the rotational direction of the rotation shaft, deteriorating working efficiency.

This invention has been developed to provide a rotary knob which can be reliably fitted on a rotation shaft and has an appropriate removal force.

The present invention provides a rotary knob including: a wall member defining a mating hole allowing a rotation shaft to be fitted therein, the rotation shaft including a shaft portion, an outer circumferential surface of which includes a flat surface extending parallel with an axis of the rotation shaft; and an elastic piece formed in a strip shape and formed on an inner surface of the wall member so as to extend along an axis of the wall member, the elastic piece being held in contact with the flat surface and elastically deformed when the rotation shaft is fitted in the mating hole. The elastic piece includes: opposite side portions and a central portion in a widthwise direction perpendicular to the axis of the wall member. The opposite side portions are fixed to the inner surface of the wall member. The elastic piece includes a convex surface constituted by the central portion which curves inward in a radial direction of the mating hole.

BRIEF DESCRIPTION OF THE DRAWINGS

The objects, features, advantages, and technical and industrial significance of the present invention will be better understood by reading the following detailed description of the embodiments of the invention, when considered in connection with the accompanying drawings, in which:

FIGS. 2A and 2B are cross-sectional views of the rotary knob taken along line A-A in FIG. 1, wherein FIG. 2A illustrates a state in which the rotary knob is not mounted on the rotation shaft, and FIG. 2B illustrates a state in which the rotary knob is mounted on the rotation shaft;

DETAILED DESCRIPTION OF THE EMBODIMENTS

Hereinafter, there will be described embodiments of the present invention by reference to the drawings.

Figure 1:
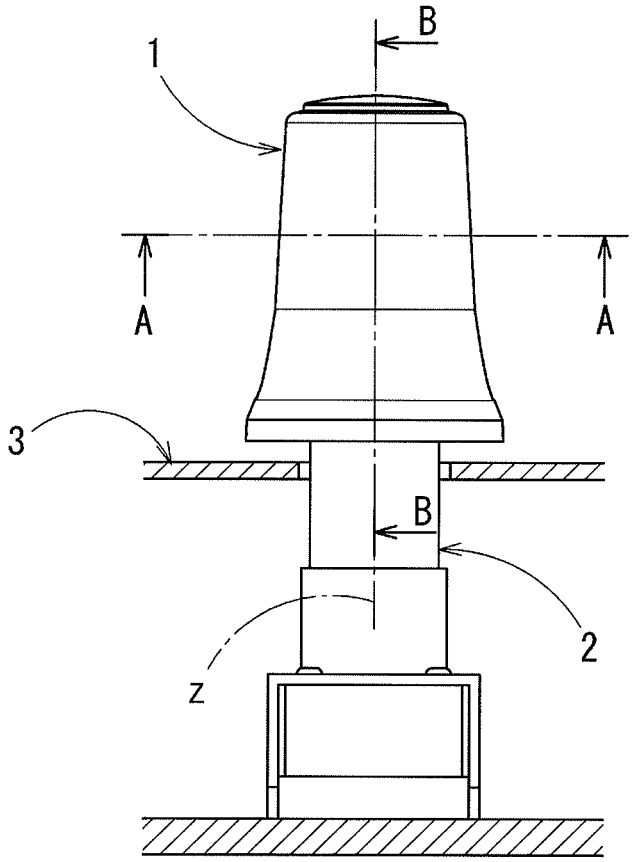
FIG. 1 is an external view illustrating a state in which a rotary knob according to a first embodiment of the present invention is fitted on a rotation shaft.

FIG. 1 illustrates a rotary or turnable knob 1 according to one embodiment of the present invention. Specifically, FIG. 1 illustrates a state in which the rotary knob 1 is mounted on a rotation shaft 2 protruding from an operation panel 3 of an electronic device or the like. With this construction, the rotary knob 1 is turnable in a state in which the rotary knob 1 is mounted on the rotation shaft 2, and the rotary knob 1 is removable from and mountable on the rotation shaft 2 for repair, for example. In the present embodiment, as illustrated in FIGS. 2A, 2B, and 3, a direction of an axis z of a shaft portion 21 of the rotation shaft 2 is defined as a z direction, and directions perpendicular to the z direction are defined as an x direction and a y direction.

In the rotation shaft 2, an outer circumferential surface of the shaft portion 21 is partly cut out so as to form a flat surface 22 which is parallel with the axis z, so that a distal end portion of the shaft portion 21 has a D-shape in cross section. As illustrated in FIG. 2A, for example, assuming that a widthwise direction of the flat surface 22 is defined as the x direction, a direction perpendicular to the flat surface 22 is defined as the y direction.

The rotary knob 1 includes an outer wall member 10 having a cylindrical shape, and this outer wall member 10 includes a top portion 11 and a side wall portion 12. In the outer wall member 10, a mating hole 40 is formed such that the shaft portion 21 of the rotation shaft 2 can be fitted in this mating hole 40. An elastic piece 50 shaped like a strip and deformable elastically is provided on an inner surface of the side wall portion 12 so as to extend along the axis z. An inner space of the outer wall member 10 is divided into two spaces by the elastic piece 50. One of the two spaces which has a larger cross-sectional area (i.e., a space defined by a convex surface 50*a* of the elastic piece 50 which will be described below and the inner surface of the side wall portion 12) is the mating hole 40 that can be fitted on a distal end portion of the rotation shaft 2.

Figure 2A:
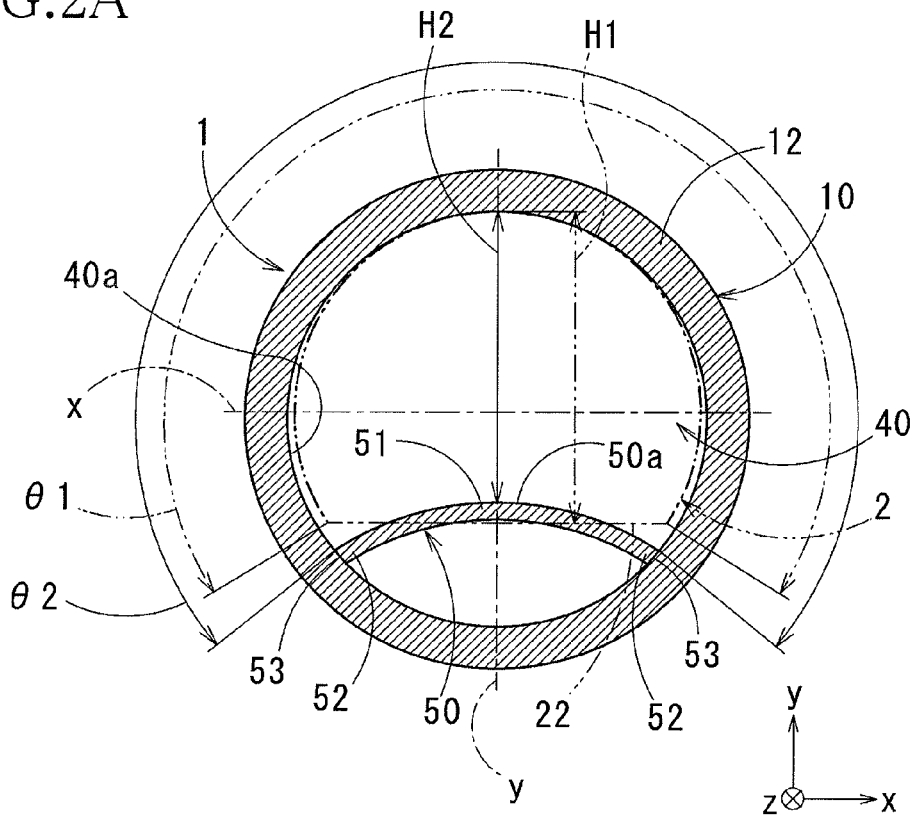
Figure 2B:
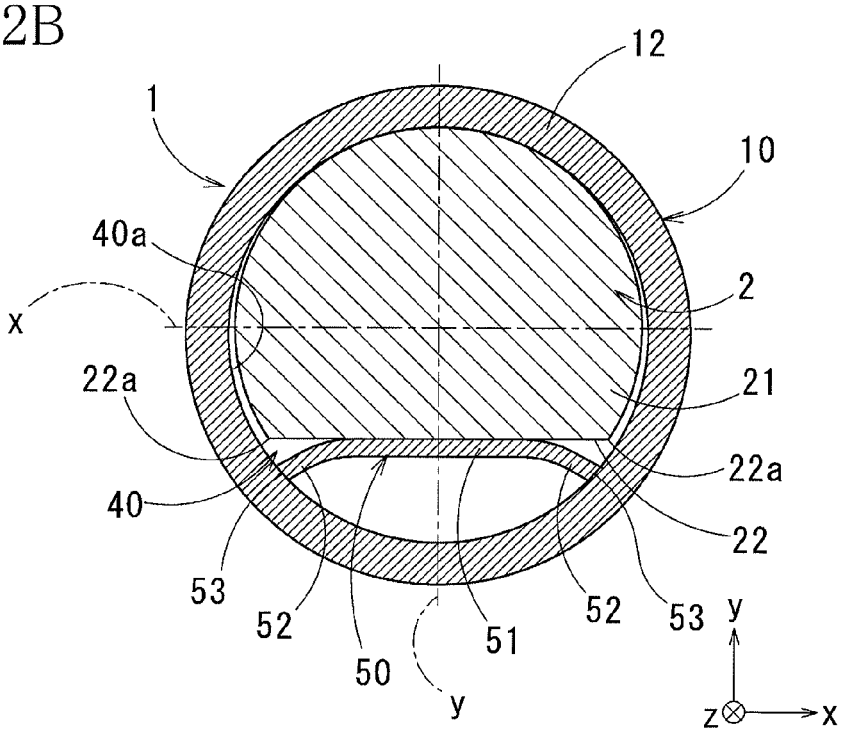
Figure 3:
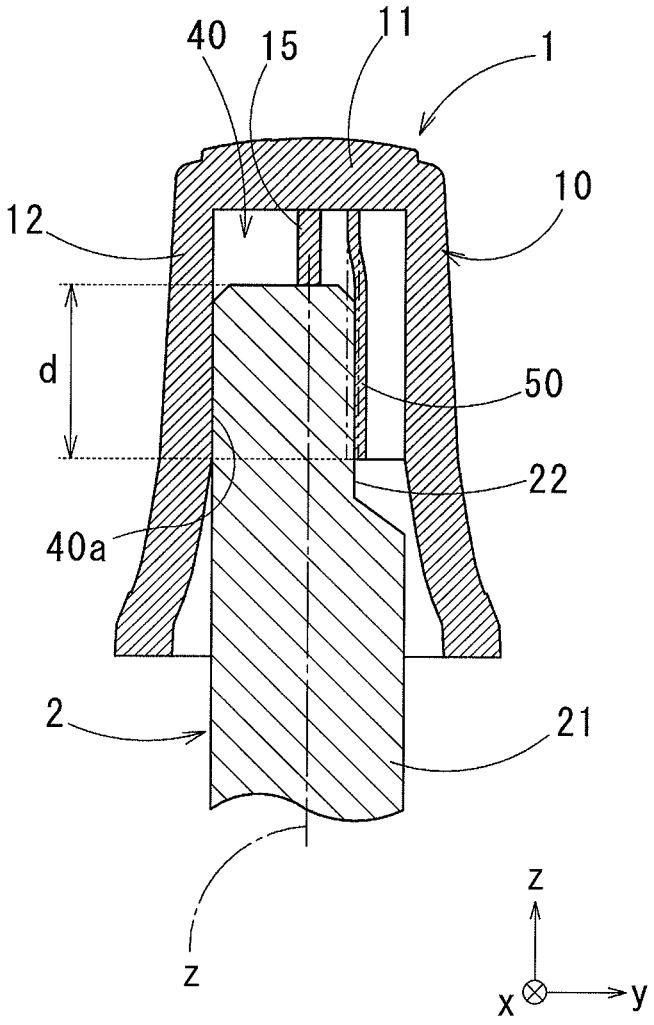
FIG. 3 is a cross-sectional view of the rotary knob and the rotation shaft taken along line B-B in FIG. 1.

As illustrated in FIG. 2A, the elastic piece 50 has opposite side portions 52 in the widthwise direction (i.e., the x direction) perpendicular to the axis z, and these opposite side portions 52 are fixed to the inner surface of the side wall portion 12. As illustrated in FIG. 3, a distal edge of the elastic piece 50 in its longitudinal direction (i.e., the z direction) is fixed to the top portion 11 of the rotary knob 1.

As illustrated in FIG. 2A, a central portion 51 of the elastic piece 50 in its widthwise direction is shaped so as to have the convex surface 50*a* curving inward in a radial direction of the mating hole 40 in a state in which the rotary knob 1 is not mounted on the rotation shaft 2. In the rotary knob 1 according to the present embodiment, the convex surface 50*a* of the elastic piece 50 extends in the z direction so as to continuously keep a smooth arc shape in cross section. That is, the convex surface 50*a* is an curved surface which curves upward in the state in which the rotary knob 1 is not mounted on the rotation shaft 2. The mating hole 40 is defined by the convex surface 50*a* of the elastic piece 50 and the inner surface of the side wall portion 12, and the shortest length H2 of the mating hole 40 in its radial direction is smaller than the shortest length H1 of the rotation shaft 2 in its radial direction (i.e., a distance of the rotation shaft 2 in its radial direction perpendicular to the flat surface 22).

As illustrated in FIG. 2A, connecting portions 53 connect between the opposite side portions 52 of the elastic piece 50 and the side wall portion 12, and these connecting portions 53 are provided such that the length of a portion of an inner circumferential surface 40*a* of the mating hole 40 between the connecting portions 53 in a circumferential direction of the rotation shaft 2 (i.e., the length of the portion of the inner circumferential surface 40*a* which is indicated by the angle θ2) is longer than the length of the outer circumferential surface of the rotation shaft 2 between opposite side edges of the flat surface 22 in the circumferential direction (i.e., the length of the outer circumferential surface of the rotation shaft 2 which is indicated by the angle θ1). In the state in which the rotation shaft 2 is fitted in the mating hole 40, the opposite side portions 52 of the elastic piece 50 are fixed to positions spaced apart from opposite side edge portions (i.e., corner portions 22*a*) of the flat surface 22 of the rotation shaft 2.

As illustrated in FIG. 3, provided on the top portion 11 of the outer wall member 10 is a stopper 15 for limiting a mating depth d of the rotation shaft 2 by contacting or receiving a distal end face of the rotation shaft 2. The mating depth d is a distance between the distal or upper end face of the rotation shaft 2 and a lower edge of the elastic piece 50. The elastic piece 50 is provided so as to extend to a position deeper or upper in the z direction than the distal end face of the rotation shaft 2 in the state in which the rotation shaft 2 is fitted in the mating hole 40. Thus, by mounting the rotary knob 1 on the rotation shaft 2 in a state in which the distal end face of the rotation shaft 2 is held in contact with the stopper 15, the distal end face of the rotation shaft 2 is spaced apart from the top portion 11 in the state in which the rotary knob 1 is mounted on the rotation shaft 2.

It is noted that the mating depth d between the elastic piece 50 and the rotation shaft 2 may be adjusted by the projecting length of the stopper 15 in the z direction and may also by adjusted by the length of the elastic piece 50 in the z direction. These adjustments provide an appropriate holding force in the state in which the rotary knob 1 is mounted on the rotation shaft 2 using the elastic piece 50, and also provide an appropriate removal force when the rotary knob 1 is inserted or removed.

In the rotary knob 1 according to the present embodiment, the outer wall member 10, the elastic piece 50, the stopper 15, and so on are integrally formed of synthetic resin but may be partly or entirely formed separately and assembled. The rotary knob 1 according to the present embodiment is formed of synthetic resin but may be formed of other materials. For example, the outer wall member 10 and the stopper 15 are formed of aluminum alloy, and the elastic piece 50 is constituted by a thin plate spring formed of stainless steel. That is, the rotary knob 1 may be formed of a plurality of materials in combination.

When the rotation shaft 2 is inserted into the mating hole 40 of the rotary knob 1 to mount the rotary knob 1 onto the rotation shaft 2, the elastic piece 50 is bent by contacting the flat surface 22 of the rotation shaft 2, and the rotation shaft 2 is pressed against the inner circumferential surface 40*a* of the mating hole 40. In this operation, the central portion 51 of the elastic piece 50 in its widthwise direction is pressed, and thereby the convex surface 50*a* of the elastic piece 50 is pressed outward in the radial direction. Consequently, as illustrated in FIG. 2B, the elastic piece 50 is held in surface contact with the flat surface 22 of the rotation shaft 2.

As illustrated in FIG. 2B, the rotation shaft 2 is held in the state in which the opposite side edge portions of the flat surface 22 are not held in contact with the elastic piece 50. That is, since the length of the portion of the inner circumferential surface 40*a* of the mating hole 40 between the connecting portions 53 in the circumferential direction of the rotation shaft 2 (i.e., the length of the portion of the inner circumferential surface 40*a* which is indicated by the angle θ2) is, as described above, longer than the length of the outer circumferential surface of the rotation shaft 2 between the opposite side edges of the flat surface 22 in the circumferential direction (i.e., the length of the outer circumferential surface of the rotation shaft 2 which is indicated by the angle θ1), the opposite side portions 52 of the elastic piece 50 are spaced apart from the opposite side edge portions of the flat surface 22 of the rotation shaft 2, and the opposite side edge portions of the flat surface 22 in its widthwise direction do not contact the elastic piece 50. Accordingly, the corner portions 22*a* provided at the opposite side edge portions of the flat surface 22 do not contact the opposite side portions 52 of the elastic piece 50, thereby preventing the elastic piece 50 from being scraped against the corner portions 22*a* of the rotation shaft 2.

Figure 4:
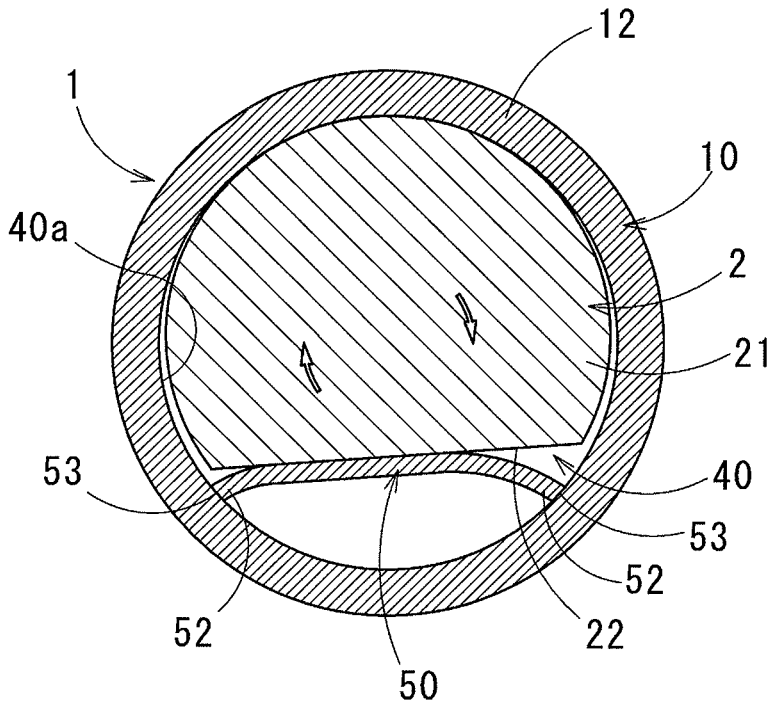
FIG. 4 is a cross-sectional view of the rotary knob in a case where the rotation shaft is fitted in an inclined state.

Even in a case where, as illustrated in FIG. 4, positions of the central portion 51 having the convex shape and the flat surface 22 of the rotation shaft 2 slightly deviate from each other in a rotational direction of the rotation shaft 2 (in other words, an angle of the rotary knob 1 with respect to the rotation shaft 2 deviate slightly) in assembling of the rotary knob 1 on the rotation shaft 2, the elastic piece 50 can be bent asymmetrically so as to match the inclination or angle of the flat surface 22 of the rotation shaft 2, facilitating fitting the rotary knob 1 onto the rotation shaft 2. In this assembling, since the elastic piece 50 is bent asymmetrically, resilience is generated against the inclination of the flat surface 22. This resilience causes the elastic piece 50 to rotate the rotary knob 1 and the rotation shaft 2 relative to each other as indicated by white arrows in FIG. 4 to correct the positional relationship between the rotary knob 1 and the rotation shaft 2, so that the rotary knob 1 and the rotation shaft 2 are assembled to generally accurate positions.

In the rotary knob 1 having the above-described construction, when the rotary knob 1 is turned in the state in which the shaft portion 21 of the rotation shaft 2 is fitted in the mating hole 40, the elastic piece 50 pressed against the flat surface 22 serves as a rotation stopper, so that the rotation shaft 2 can be turned with a turn of the rotary knob 1.

Also, the elastic force or resilience of the elastic piece 50 can absorb a slight error in the diameter of the rotation shaft 2 to reliably keep the rotary knob 1 to be mounted on the rotation shaft 2. Furthermore, this construction provides an appropriate removal force when the rotary knob 1 is inserted or removed. Some materials for the rotary knob 1 enable the side wall portion 12 itself to be elastically deformed when the rotation shaft 2 is fitted, providing the appropriate holding force and removal force between the rotary knob 1 and the rotation shaft 2.

As illustrated in FIG. 2A, the convex surface 50*a* of the elastic piece 50 is constituted by a smoothly continuous curved surface. Thus, even the elastic piece 50 is bent when the rotation shaft 2 is fitted, the elastic piece 50 is gradually bent between the opposite side portions 52 without a great change in shape. This construction can reduce concentration of stress locally generated in the elastic piece 50, thereby improving reliability for long-term use and maintaining the appropriate removal force.

In the rotary knob 1 according to the present embodiment, the one end portion of the elastic piece 50 is fixed to the top portion 11 of the outer wall member 10. If the distal end face of the rotation shaft 2 is in contact with the top portion 11 in the state in which the rotary knob 1 is mounted on the rotation shaft 2, a larger stress is generated on the fixed edge portion of the elastic piece 50, which may break the elastic piece 50.

However, since the rotary knob 1 is provided with the stopper 15 for limiting the mating depth d of the rotation shaft 2, the distal end face of the rotation shaft 2 can be kept apart from the top portion 11. Accordingly, even in the case where the elastic piece 50 is fixed to the top portion 11, the elastic piece 50 can be elastically deformed without break, thereby maintaining the appropriate removal force generated by the elastic piece 50.

The elastic piece 50 is fixed to the top portion 11 of the rotary knob 1 and can be manufactured at low cost without using a complicated mold.

Figure 5:
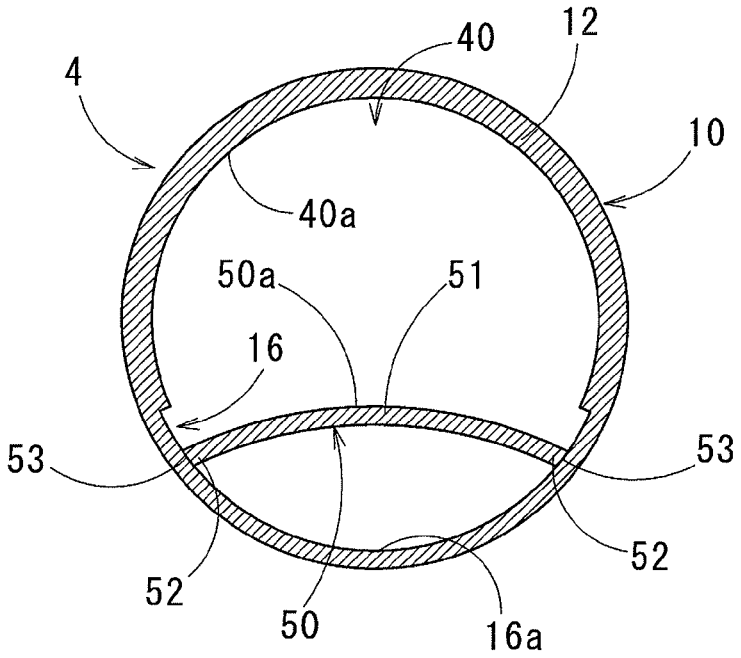
FIG. 5 is a cross-sectional view for explaining a rotary knob according to a second embodiment of the present invention.

FIG. 5 illustrates a rotary knob 4 according to a second embodiment of the present invention.

The inner surface of the side wall portion 12 of the rotary knob 4 is formed with a recessed groove 16 such that the connecting portions 53 at which the opposite side portions 52 of the elastic piece 50 are fixed are located on an outer side in the radial direction than the inner circumferential surface 40*a* of the mating hole 40. In the example illustrated in FIG. 5, the radius of an arc surface 16*a* of the recessed groove 16 is larger than that of the inner circumferential surface 40*a* of the mating hole 40, and the opposite side portions 52 of the elastic piece 50 are fixed to the arc surface 16*a* of the recessed groove 16.

It is noted that the recessed groove 16 may be formed by injection molding but may be formed by other methods such as cutting.

In deformation of the elastic piece 50, in this construction, the central portion 51 is pressed outward by contacting the flat surface of the rotation shaft, which generates a stress on the fixed opposite side portions 52. However, the recessed groove 16 increases the width of the elastic piece 50, making it easier for the elastic piece 50 to bend, resulting in reduction of the stress generated on the opposite side portions 52. Accordingly, it is possible to improve reliability for long-term use of the rotary knob 4 and maintain an appropriate removal force.

It is noted that the recessed groove 16 does not need to be formed in the entire inner surface of the side wall portion 12 other than its portion defining the mating hole 40 and only has to be formed in a portion of the inner surface at which the opposite side portions 52 of the elastic piece 50 are fixed to the side wall portion 12.

The other construction is the same as that in the first embodiment. Thus, the same reference numerals as used in the first embodiment are used to designate the corresponding elements of this embodiment, and an explanation of which is dispensed with.

While the embodiments of the present invention have been described above, it is to be understood that the invention is not limited to the details of the illustrated embodiments, but may be embodied with various changes and modifications, which may occur to those skilled in the art, without departing from the spirit and scope of the invention.

Figure 6:
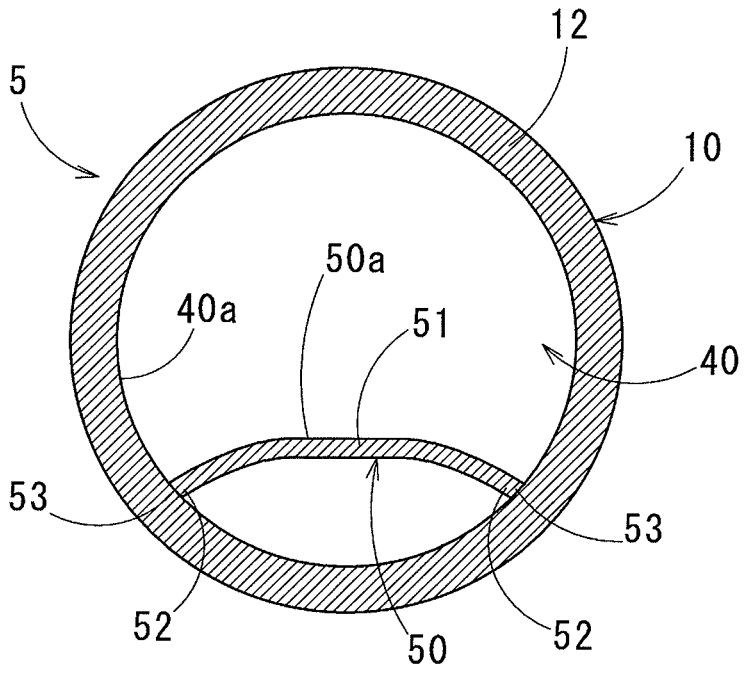
FIG. 6 is a cross-sectional view for explaining a rotary knob according to an alternative embodiment of the present invention.

For example, while the convex surface 50*a* of the elastic piece 50 has an arc shape in the above-described embodiment, the present invention is not limited to this construction. Similar effects can be obtained by the convex surface 50*a* having other shapes as long as the convex surface 50*a* is in surface contact with the flat surface 22 of the rotation shaft 2 in the state in which the rotary knob is mounted on the rotation shaft 2. For example, the convex surface of the elastic piece may be constituted by a polyhedron. Also, like a rotary knob 5 illustrated in FIG. 6, the convex surface may be constructed such that the central portion 51 of the elastic piece 50 has a planar shape, and each of the opposite side portions 52 has an arc shape.

What is claimed is:

1. A rotary knob comprising:

a wall member defining a mating hole allowing a rotation shaft to be fitted therein, the rotation shaft comprising a shaft portion, an outer circumferential surface of which comprises a flat surface extending parallel with an axis of the rotation shaft; and an elastic piece formed in a strip shape and formed on an inner surface of the wall member so as to extend along an axis of the wall member, the elastic piece being held in contact with the flat surface and elastically deformed when the rotation shaft is fitted in the mating hole, the elastic piece comprising: opposite side portions and a central portion in a widthwise direction perpendicular to the axis of the wall member, the opposite side portions being fixed to the inner surface of the wall member, the elastic piece comprising a convex surface constituted by the central portion which curves inward in a radial direction of the mating hole.

2. The rotary knob according to claim 1, wherein when the rotation shaft is fitted in the mating hole, the convex surface of the elastic piece is in surface contact with the flat surface.

3. The rotary knob according to claim 1, wherein the elastic piece curves inward in the radial direction, regardless of whether the rotation shaft is fitted in the mating hole.

4. The rotary knob according to claim 1, wherein the convex surface of the elastic piece is formed in a smooth continuous shape.

5. The rotary knob according to claim 1, wherein the inner surface of the wall member is formed with a recessed groove such that a plurality of connecting portions at which the opposite side portions of the elastic piece are fixed are located on an outer side in the radial direction than an inner circumferential surface of the mating hole.

6. The rotary knob according to claim 1, further comprising a stopper provided in the wall member, the stopper being configured to limit a mating depth of the rotation shaft, wherein the elastic piece extends to a position deeper than the mating depth limited by the stopper.

7. The rotary knob according to claim 1, wherein, when the rotation shaft is fitted in the mating hole, the central portion of the elastic piece in the widthwise direction is in contact with the flat surface of the rotation shaft and the opposite side portions of the elastic piece in the widthwise direction are not in contact with the flat surface of the rotation shaft.

8. The rotary knob according to claim 1, wherein the elastic piece and the wall member are integrally formed of synthetic resin.

* * * * *